US010362647B2

(12) United States Patent
Wu

(10) Patent No.: US 10,362,647 B2
(45) Date of Patent: Jul. 23, 2019

(54) AMPLITUDE DIMMING POWER SUPPLY FOR CONSTANT-VOLTAGE LED LAMP GROUP

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventor: Dong Wu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/017,672

(22) Filed: Jun. 25, 2018

(65) Prior Publication Data

US 2019/0069360 A1 Feb. 28, 2019

(30) Foreign Application Priority Data

Aug. 25, 2017 (CN) ..... 2017 1 0738736

(51) Int. Cl.
*H05B 33/08* (2006.01)

(52) U.S. Cl.
CPC ..... *H05B 33/0818* (2013.01); *H05B 33/0827* (2013.01); *H05B 33/0845* (2013.01); *H05B 33/0851* (2013.01)

(58) Field of Classification Search
CPC ..... H05B 33/0815; H05B 33/0818; H05B 33/0827; H05B 33/0845
USPC ..... 315/200 R, 307, 308, 294, 224
See application file for complete search history.

(56) References Cited

U.S. PATENT DOCUMENTS

2011/0248640 A1* 10/2011 Welten ..... H05B 33/0815 315/210
2013/0342122 A1* 12/2013 Sawada ..... H03K 17/51 315/200 R
2014/0077724 A1* 3/2014 Sawada ..... H02M 3/157 315/307
2014/0265900 A1* 9/2014 Sadwick ..... H05B 33/0803 315/200 R
2015/0208472 A1* 7/2015 Liu ..... H05B 33/0815 315/206

* cited by examiner

*Primary Examiner* — Douglas W Owens
*Assistant Examiner* — Syed M Kaiser
(74) *Attorney, Agent, or Firm* — Wang Law Firm, Inc.

(57) ABSTRACT

A amplitude dimming power supply for constant-voltage LED lamp group comprises a maximum current signal conversion module, a DAC module electrically connected with the maximum current signal conversion module, a dimming signal output module, a signal processing module electrically connected with the dimming signal output module and the DAC module, a lamp group current sampling module, and a comparison control input module. The present invention is directed to the constant-voltage LED lamp group amplitude dimming, the dimming current is based on constant-voltage LED lamp group real-time changes. Constant-voltage LED lamp group maximum dimming current determines the duty cycle and the amplitude of the PWM signal output by the maximum current signal conversion module, so that the maximum dimming current of the amplitude dimming power of the constant-voltage LED lamp group is always equal to the total current of the current LED lamp group. The amplitude dimming power supply can work in full scale range and the phenomenon of dead zone doesn't appear.

11 Claims, 2 Drawing Sheets

AMPLITUDE DIMMING POWER SUPPLY FOR CONSTANT-VOLTAGE LED LAMP GROUP

CROSS-REFERENCE TO A RELATED APPLICATION

This application claims priority to a Chinese Patent Application No. CN 201710738736.2, filed on Aug. 25, 2017.

FIELD OF THE TECHNOLOGY

The present invention relates to a power supply for LED lamps, with particular emphasis on a amplitude dimming power supply for constant-voltage LED lamp group.

BACKGROUND

In ordinary daily life, all kinds of lighting apparatus can be seen everywhere, such as fluorescent lamps, street lamps, table lamps, artistic lamps and so on. In the above-described lighting apparatus, the tungsten bulb is traditionally used as a light-emitting light source. In recent years, due to the ever-changing technology, light-emitting diode (LED) has been used as a light source. Moreover, in addition to lighting apparatus, for the general traffic signs, billboards, headlights etc., light-emitting diode has also been used as a light source. The light-emitting diode as a light source has the advantages of energy-saving and greater brightness. Therefore, it has been gradually common.

With the popularity of LED lamps, LED lamps are used in more and more occasions, but as we all know, LED lamps are powered by a dedicated LED power supply. At the same time, with the improvement of living standard, people need to the LED lamp with variable brightness. Therefore, the LED power with variable output is needed. In the prior art, there are many LED power supplies with variable output that can change the output brightness of the LED lamps. However, these LED power supplies in some cases do not give users a very good experience of using light, for example in display lighting or in the museum, many users prefer to use a mobile phone or a camera to photograph the displayed items. However, the existing LED power supply with variable output power makes the light source provided by the LED lamp form a lot of photos taken by the mobile phone or the camera and make the picture distorted, affect the user's light experience.

In the prior art, the brightness of the LED lamp is adjusted by using a current adjusting method, which can avoid the phase flash. But this method is generally applicable to a constant current lamp or lamp group. For unknown constant current value flowing through a lamp or lamp group, such as in a freezer or showcase, the customer does not know how many lamps form a lamp group, but only want to use a constant-voltage dimming power supply. Because the current flowing through the lamp system is unknown, it is difficult to obtain an effective dimming effect by using the existing current dimming method. For example, when the total current of the lamp group is greater than the maximum dimming current in the existing dimming method, and the maximum dimming current is exceeded, the existing current dimming method is often ineffective, and a phenomenon of dead zone will appear.

SUMMARY OF THE INVENTION

Therefore, it is necessary to provide an amplitude dimmable power supply for a constant-voltage LED lamp which can avoid dimming failure to solve the above problems.

A amplitude dimming power supply for constant-voltage LED lamp group, the constant-voltage LED lamp group comprising a lamp or a plurality of lamps connected in parallel operating at a constant-voltage, comprising: a maximum current signal conversion module, a DAC module electrically connected with the maximum current signal conversion module, a dimming signal output module, a signal processing module electrically connected with the dimming signal output module and the DAC module, a lamp group current sampling module, and a comparison control input module;

the maximum current signal conversion module configured to convert a maximum current flowing through the constant-voltage LED lamp group into a PWM signal, the DAC module configured to convert the PWM signal output by the maximum current signal conversion module into a current parameter value Imax output, the dimming signal output module configured to output a dimming parameter value Da, and the signal processing Module for multiplying the current parameter value Imax by a dimming parameter value Da to obtain a dimming reference current value, the lamp group current sampling module configured to collect a total current value of a constant-voltage LED lamp group, the comparison control input module configured to compare the dimming reference current value with the total current value to make the total current value equal to the dimming reference current value to adjust the output parameter of the constant-voltage LED lamp group.

Further, the signal processing module comprises a MOS transistor Q3, gate of the MOS transistor Q3 is electrically connected with the dimming signal output module, drain is electrically connected with the DAC module, and source is grounded.

Further, the signal processing module further comprises at least one stage RC filter circuit, the RC filter circuit comprises a resistor and a capacitor, one end of the resistor is electrically connected to the drain of the MOS transistor Q3, the other end of the resistor is connected to the capacitor, and the other end of the capacitor is grounded; output terminal of the signal processing module is electrically connected between the resistor and the capacitor.

Further, the signal processing module comprises a first-stage and a second-stage RC filter circuits, the first-stage filter circuit comprises a resistor R2 and a capacitor C4, one end of the resistor R2 is electrically connected to the drain of the MOS transistor Q3, the other end of the resistor R2 is connected to the capacitor C4, and the other end of the capacitor C4 is grounded. The second-stage filter circuit comprises a resistor R15 and a capacitor C6, one end of the resistor R15 is connected between the resistor R2 and the capacitor C4, the other end of the resistor R15 is connected to the capacitor C6, and the other end of the capacitor C6 is grounded; output terminal of the signal processing module is electrically connected between the resistor R15 and Capacitor C6.

Further, the amplitude dimming power supply further comprises a dimming signal conversion module, the dimming signal conversion module is electrically connected between the dimming signal output module and the signal processing module for converting the signal output by the dimming signal output module into a PWM signal.

Further, the functions of the dimming signal conversion module and the dimming signal output module are executed by a single chip.

Further, the DAC module comprises an operational amplifier N1A, the anti-phase input terminal of the operational amplifier N1A is electrically connected with a maximum current signal conversion module, the in-phase input is electrically connected to a reference voltage, the positive power supply is electrically connected to a power supply, and the negative power supply is grounded.

Further, the DAC module further comprises an RC filter electrically connected to an operational amplifier N1A, the RC filter comprises a resistor R7 electrically connected between the anti-phase input and the output terminal, a capacitor C1 connected in parallel with the resistor R7.

Further, the comparison control input module comprises an operational amplifier N1B, the in-phase input terminal of the operational amplifier N1B is electrically connected with lamp group current sampling module, anti-phase input is electrically connected to the signal processing module.

Further, the comparison control input module further comprises a control unit electrically connected with the output terminal of the operational amplifier N1B, the control unit is configured to adjust the output parameter of the constant-voltage LED lamp group according to the output of the operational amplifier N1B.

Compared with the prior art, the present invention is directed to the constant-voltage LED lamp group amplitude dimming, the dimming current is based on constant-voltage LED lamp group real-time changes. Constant-voltage LED lamp group maximum dimming current determines the duty cycle and the amplitude of the PWM signal output by the maximum current signal conversion module, so that the maximum dimming current of the amplitude dimming power of the constant-voltage LED lamp group is always equal to the total current of the current LED lamp group. The amplitude dimming power supply can work in full scale range and the phenomenon of dead zone doesn't appear.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
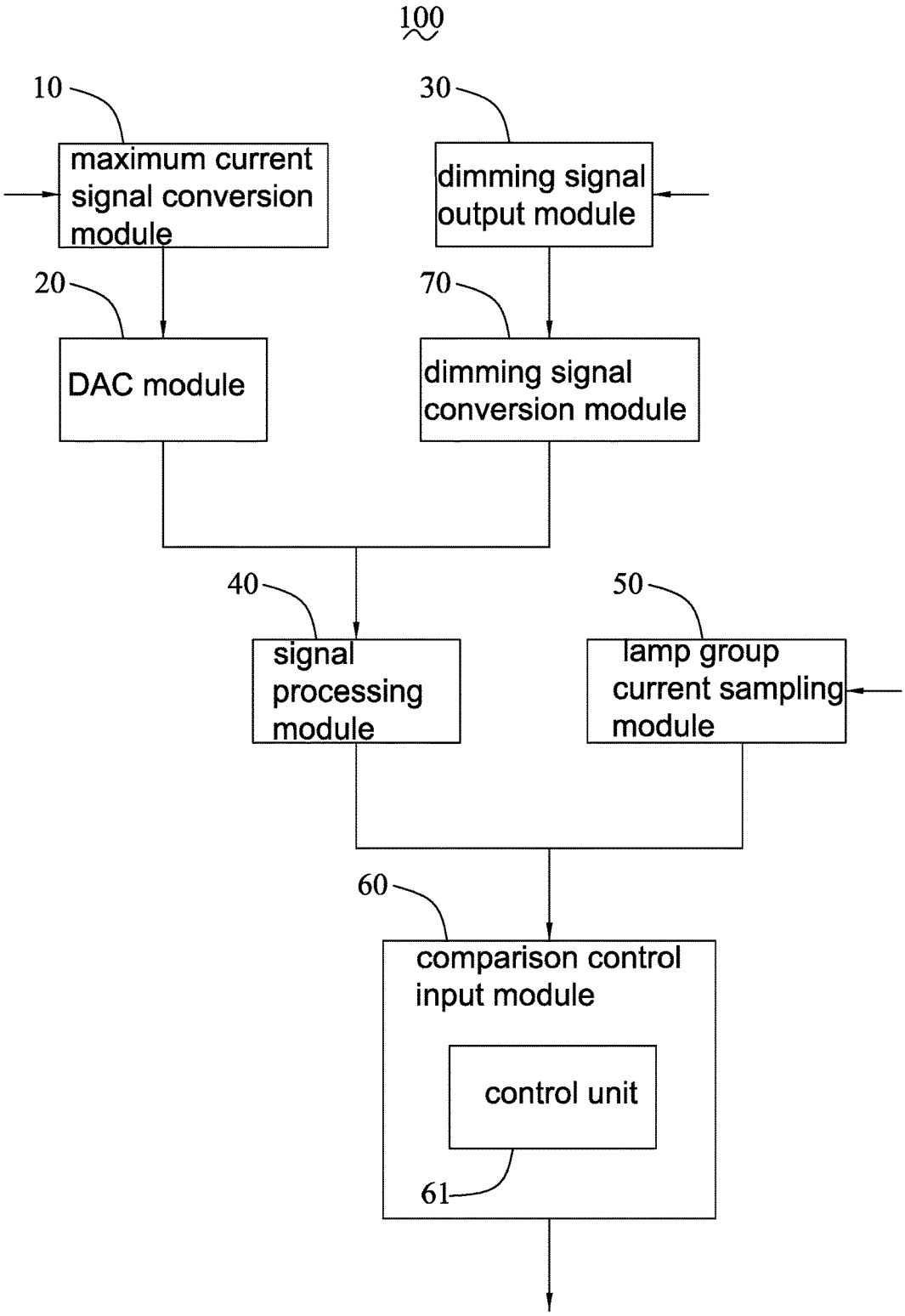
FIG. 1 is a principle block diagram of an amplitude dimming power supply for a constant-voltage LED lamp group provided by the present invention.
Figure 2:
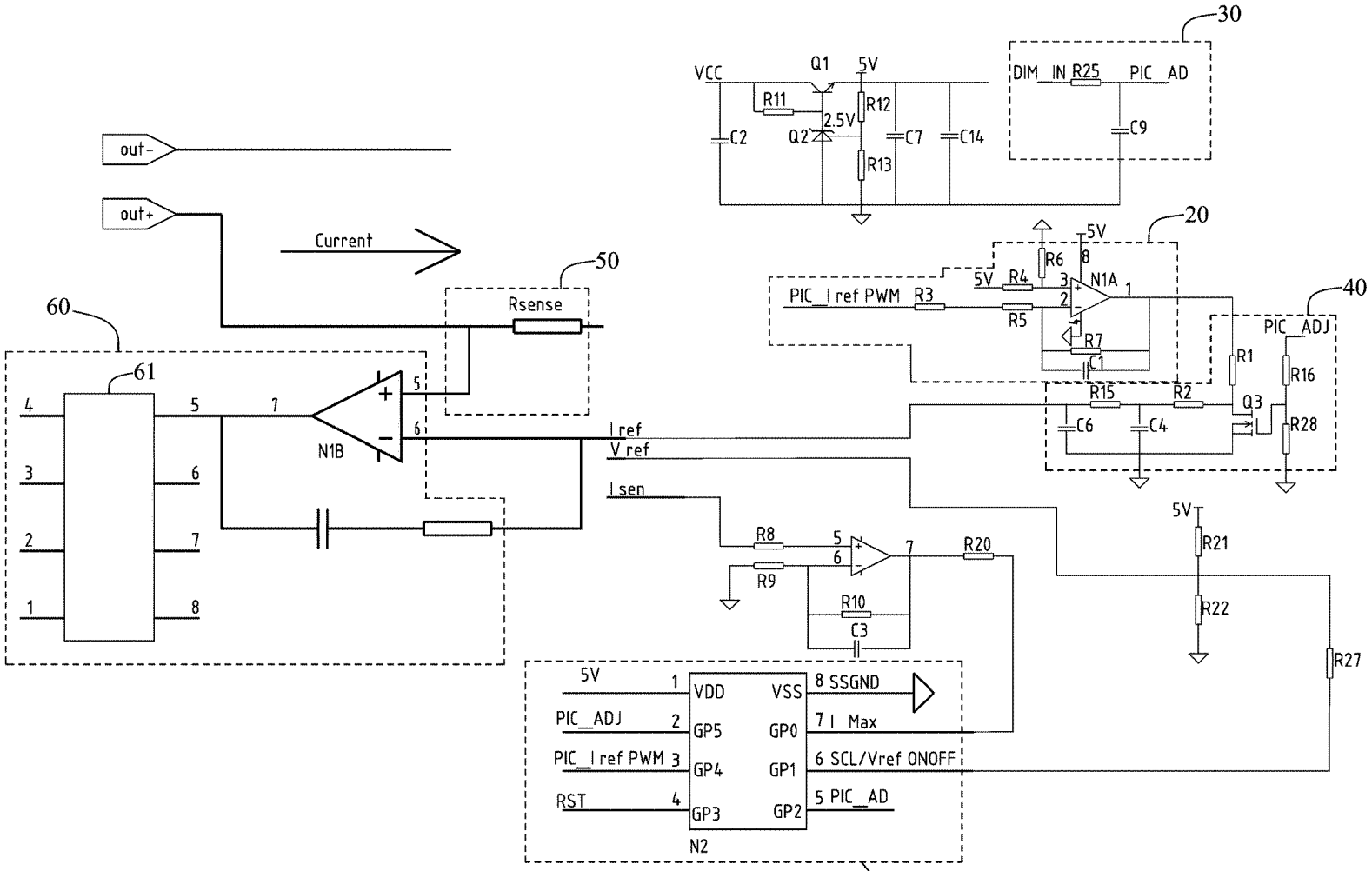
FIG. 2 is an application circuit diagram of the amplitude dimming power supply for the constant-voltage LED lamp group of FIG. 1.

Please referring to FIG. 1 to FIG. 2, which are a principle block diagram and an application circuit diagram of an amplitude dimming power supply 100 for a constant-voltage LED lamp group provided by the present invention. The amplitude dimming power supply 100 for a constant-voltage LED lamp group comprises a maximum current signal conversion module 10, a DAC module 20 electrically connected to the maximum current signal conversion module 10, a dimming signal output module 30, a signal processing module 40 electrically connected to the dimming signal output module 30 and the DAC module 20, a lamp group current sampling module 50, and a comparison control input module 60. It is conceivable that the amplitude dimming power supply 100 for a constant-voltage LED lamp group further comprises other functional modules, such as a power conversion module, a power factor correction module, a rectification module provided by a general LED power supply. This should be a technique known to those skilled in the art, and details are not described herein again. The constant-voltage LED lamp group may comprise one independent lamp, or a plurality of independent lamps connected in parallel to form the lamp group. a lot of lamps can be connected in parallel by using this parallel method, the number of lamps is not certain so the total power is also not certain, and the lamp group need to work at a constant-voltage. However, the user doesn't know how many lamps need to used, that is, the number of lamps that make up the lamp group is not certain. That is, when using the amplitude dimming power supply 100 for the constant-voltage LED lamp group, the total power of the constant-voltage fixture lamp group is unknown. However, in the present invention, the total power of the constant-voltage lamp group is already certain, that is, the number of lamp groups is certain, that is, the maximum dimming current has been determined.

The maximum current signal conversion module 10 is configured to convert a maximum current flowing through the constant-voltage LED lamp group into a PWM signal. As described above, the maximum current signal conversion module 10 converts the maximum dimming current into a PWM signal when the maximum dimming current has been determined. It can be understood that converting the maximum dimming current into the PWM signal can be achieved by using conventional electronic components such as diodes and triodes, or by using the integrated circuit. In this embodiment, for convenience and cost reduction and space saving, the maximum current signal conversion module 10 converts the maximum current into a PWM signal by using a single chip microcomputer. As for how the microcontroller converts the maximum current into a PWM signal, it should be a microcontroller technology known to those skilled in the art and will not be described in detail here.

The DAC module 20 is configured to convert the PWM signal output by the maximum current signal conversion module 10 into a current parameter value Imax to output. In order to meet the safety requirements, the maximum current signal conversion module 10 needs to be electrically isolated from the DAC module 20 and other functional modules such as the signal processing module 50. Therefore, the current signal needs to be converted into a PWM signal and then utilizes optocoupler to complete the signal transmission and electrical isolation, and finally the PWM signal is converted to analog signals. The DAC module 20 can be implemented by an integrated circuit such as a single-chip microcomputer and a microprocessor, and can also be constructed by ordinary electronic components when considering of the cost. In the present embodiment, the DAC module 20 is composed of common electronic components and comprises an operational amplifier N1A. The anti-phase input terminal of the operational amplifier N1A is electrically connected with the maximum current signal conversion module 10 to receive the converted PWM signal, the in-phase input terminal is electrically connected to a reference voltage, the positive power terminal is electrically connected to a power supply, and the negative power terminal is grounded. As described above, the PWM signal converted by the maximum current signal conversion module 10 is electrically connected to the anti-phase input terminal of the operational amplifier N1A through the optocoupler. In this embodiment, the reference voltage is 5 volts. It is conceivable that the value of the reference voltage is different depending on the needs, and varies depending on the specifications of various electronic components, so the value of the reference voltage can vary. The PWM signal is further converted into a current signal by the operational amplifier N1A, that is, the current parameter value Imax is output. In order to prevent the noise generated during the conversion from interfering with the subsequent output, the DAC module 20 further comprises an RC filter electrically connected to the operational amplifier N1A. The RC filter comprises a resistor R7 electrically connected between the anti-phase input and the output, and a capacitor C1 connected in parallel with the resistor R7. the value of the current parameter Imax output by the DAC module 20 will be a line that tends to be straight through the function of the RC filter.

The dimming signal output module 30 is configured to output a dimming parameter value Da. The dimming signal output module 30 is a man-machine exchange module that can communicate with a user. That is, the user can output the desired dimming value through the dimming signal output module 30 as needed. In the prior art, the dimming signal output module 30 is generally a 1-10 volt dimming signal. Depending on the value of 1-10 volts entered, this represents a ratio such as 10% for 1 volt and 50% for 5 volt. Therefore, the dimming parameter value Da is the ratio value. As for the specific circuit of the dimming signal output module 30, it should be a circuit known from dimming power supplies in the prior art and will not be described in detail herein.

The amplitude dimming power supply 100 for the constant-voltage LED lamp group further comprises a dimming signal conversion module 70. The dimming signal conversion module 70 is electrically connected between the dimming signal output module 30 and the signal processing module 40 for converting the signal output from the dimming signal output module 30, that's, the dimming parameter Da, into PWM signal. The reason for setting the dimming signal conversion module 70 is also due to safety reasons, so it needs to be isolated. Generally, the dimming power supply is isolated by using an optocoupler because of the cost and space constraints. Therefore, the dimming signal parameter value Da is converted to a PWM signal firstly. The maximum current signal conversion module 10 and the dimming signal conversion module 70 also use the above-mentioned single chip microcomputer to complete the signal format conversion.

The signal processing module 40 is configured to multiply the current parameter value Imax and the dimming parameter value Da to obtain a dimming reference current value. Therefore, the module multiplier 40 is electrically connected to the dimming signal output module 30 and the output of the DAC module 20. The signal processing module 40 multiplies the current parameter value Imax and the dimming parameter value Da to obtain a current value for adjusting the output of the constant-voltage LED lamp group. The signal processing module 40 can be implemented by an integrated circuit such as a single-chip microcomputer or a microprocessor. Alternatively it can also be constructed by ordinary electronic components when considering of the cost. In the present embodiment, the signal processing module 40 is composed of ordinary electronic components and comprises a MOS transistor Q3, the gate of the MOS transistor Q3 is electrically connected to the dimming signal output module 30, the drain of the transistor Q3 is electrically connected to a DAC module 20 and the source is grounded. In this embodiment, firstly the gate is electrically connected to the dimming signal conversion module 60 and then electrically connected to the dimming signal output module 30 to receive the PWM signal output by the dimming signal conversion module 60. The MOS transistor Q3 can be switched between on and off by the PWM signal, and the on-off duration of the MOS transistor Q3 can be adjusted by adjusting the duty cycle of the PWM signal. The output of the signal processing module 40 is electrically connected to the drain of the MOS transistor Q3. When the MOS transistor Q3 is turned on and off, the current parameter Imax is switched between on and off. And the duration of on and off is controlled by the duty cycle of the PWM signal to achieve the purpose of multiplying the current parameter value Imax by the dimming parameter value Da and the product, that is, Light reference current value will be output. In order to eliminate the noise mixed in the product, the signal processing module 40 further comprises at least a first-level RC filter circuit, the RC filter circuit comprises a resistor and a capacitor, one end of the resistor is electrically connected to the drain of the MOS transistor Q3, the other end of the resistor is connected to the capacitor, and the other end of the capacitor is grounded; output terminal of the signal processing module 40 is electrically connected between the resistor and the capacitor.

In this embodiment, the signal processing module comprises a first-stage and a second-stage RC filter circuits, the first-stage filter circuit comprises a resistor R2 and a capacitor C4, one end of the resistor R2 is electrically connected to the drain of the MOS transistor Q3, the other end of the resistor R2 is connected to the capacitor C4, and the other end of the capacitor C4 is grounded. The second-stage filter circuit comprises a resistor R15 and a capacitor C6, one end of the resistor R15 is connected between the resistor R2 and the capacitor C4, the other end of the resistor R15 is connected to the capacitor C6, and the other end of the capacitor C6 is grounded; output terminal of the signal processing module is electrically connected between the resistor R15 and Capacitor C6.

The lamp group current sampling module 50 is configured to collect a total current value of a constant-voltage LED lamp group. The sampling circuit used by the current lamp group current sampling module 50 should be well known to those skilled in the art. It is also relatively simple to set a resistor Rsense in the circuit of the constant-voltage LED lamp group, and detecting the current flowing through the resistor Rsense Of the current can be collected by collecting the total current value of the constant-voltage LED lamp group.

The comparison control input module 60 is configured to compare the dimming reference current value with the total current value and make the total current value equal to the dimming reference current value to adjust the output parameter from the constant-voltage LED lamp group.

The comparison control input module 60 comprises an operational amplifier N1B and a control unit 61 electrically connected with the output terminal of the operational amplifier N1B, the in-phase input terminal of the operational amplifier N1B is electrically connected with lamp group current sampling module, anti-phase input is electrically connected to the signal processing module 40. The operational amplifier N1B can compare the dimming reference current value with the total current value and make the output of the operational amplifier N1B tend to be the same as the dimming reference current value so as to adjust the current of the constant current LED lamp group. The control unit 61 is configured to adjust the output parameter of the constant-voltage LED lamp group according to the output of the operational amplifier N1B. The control unit 61 may be a DC/DC module, which is a prior art and can adjust the current loaded in the constant-voltage LED lamp group according to the output of the operational amplifier N1B to achieve the ultimate purpose that the constant-voltage LED lamp group output parameters are adjusted.

Compared with the prior art, the present invention is directed to the constant-voltage LED lamp group amplitude dimming, the dimming current is based on constant-voltage LED lamp group real-time changes. Constant-voltage LED lamp group maximum dimming current determines the duty cycle and the amplitude of the PWM signal output by the maximum current signal conversion module, so that the maximum dimming current of the amplitude dimming power of the constant-voltage LED lamp group is always equal to the total current of the current LED lamp group. The amplitude dimming power supply can work in full scale range and the phenomenon of dead zone doesn't appear.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A amplitude dimming power supply for constant-voltage LED lamp group, the constant-voltage LED lamp group comprising a lamp or a plurality of lamps connected in parallel operating at a constant-voltage, comprising:

a maximum current signal conversion module, a DAC module electrically connected with the maximum current signal conversion module, a dimming signal output module, a signal processing module electrically connected with the dimming signal output module and the DAC module, a lamp group current sampling module, and a comparison control input module;

the maximum current signal conversion module configured to convert a maximum dimming current flowing through the constant-voltage LED lamp group into a PWM signal, the DAC module configured to convert the PWM signal output by the maximum current signal conversion module into a current parameter value Imax output, the dimming signal output module configured to output a dimming parameter value Da, and the signal processing Module for multiplying the current parameter value Imax by a dimming parameter value Da to obtain a dimming reference current value, the lamp group current sampling module configured to collect a total current value of a constant-voltage LED lamp group, the comparison control input module configured to compare the dimming reference current value with the total current value to make the total current value equal to the dimming reference current value to adjust the output parameter of the constant-voltage LED lamp group.

2. The amplitude dimming power supply for constant-voltage LED lamp group as claimed in claim 1, wherein the signal processing module comprises a MOS transistor (Q3), a gate of the MOS transistor (Q3) is electrically connected with the dimming signal output module, a drain is electrically connected with the DAC module, and a source is grounded.

3. The amplitude dimming power supply for constant-voltage LED lamp group as claimed in claim 2, wherein the signal processing module further comprises at least one stage RC filter circuit, the RC filter circuit comprises a resistor and a capacitor, one end of the resistor is electrically connected to the drain of the MOS transistor (Q3), the other end of the resistor is connected to the capacitor, and the other end of the capacitor is grounded; an output terminal of the signal processing module is electrically connected between the resistor and the capacitor.

4. The amplitude dimming power supply for constant-voltage LED lamp group as claimed in claim 3, wherein the signal processing module comprises a first-stage and a second-stage RC filter circuits, the first-stage filter circuit comprises a resistor (R2) and a capacitor (C4), one end of the resistor (R2) is electrically connected to the drain of the MOS transistor (Q3), an other end of the resistor (R2) is connected to an end of the capacitor (C4), and an other end of the capacitor (C4) is grounded; the second-stage filter circuit comprises a resistor (R15) and a capacitor (C6), one end of the resistor (R15) is connected between the resistor (R2) and the capacitor (C4), an other end of the resistor (R15) is connected to the capacitor (C6), and an other end of the capacitor (C6) is grounded; the output terminal of the signal processing module is electrically connected between the resistor (R15) and Capacitor (C6).

5. The amplitude dimming power supply for constant-voltage LED lamp group as claimed in claim 2, wherein the amplitude dimming power supply further comprises a dimming signal conversion module, the dimming signal conversion module is electrically connected between the dimming signal output module and the signal processing module for converting the signal output by the dimming signal output module into a PWM signal.

6. The amplitude dimming power supply for constant-voltage LED lamp group as claimed in claim 5, wherein the functions of the dimming signal conversion module and the dimming signal output module are executed by a single chip.

7. The amplitude dimming power supply for constant-voltage LED lamp group as claimed in claim 1, wherein the DAC module comprises an operational amplifier (N1A), the anti-phase input terminal of the operational amplifier (N1A) is electrically connected with a maximum current signal conversion module, the in-phase input is electrically connected to a reference voltage, the positive power supply is electrically connected to a power supply, and the negative power supply is grounded.

8. The amplitude dimming power supply for constant-voltage LED lamp group as claimed in claim 1, wherein the DAC module further comprises an RC filter electrically connected to an operational amplifier (N1A), the RC filter comprises a resistor (R7) electrically connected between the anti-phase input and an output terminal, a capacitor (C1) connected in parallel with the resistor (R7).

9. The amplitude dimming power supply for constant-voltage LED lamp group as claimed in claim 1, wherein the comparison control input module comprises an operational amplifier (N1B), the in-phase input terminal of the operational amplifier (N1B) is electrically connected with lamp group current sampling module, anti-phase input is electrically connected to the signal processing module.

10. The amplitude dimming power supply for constant-voltage LED lamp group as claimed in claim 1, wherein the comparison control input module further comprises a control unit electrically connected with an output terminal of the operational amplifier (N1B), the control unit is configured to adjust the output parameter of the constant-voltage LED lamp group according to the output of the operational amplifier (N1B).

11. The amplitude dimming power supply for constant-voltage LED lamp group as claimed in claim 1, wherein the maximum dimming current is a predetermined value proportional to the lamps present in the constant-voltage LED lamp group.

* * * * *